US011441460B2

(12) United States Patent
Mohiuddin et al.

(10) Patent No.: US 11,441,460 B2
(45) Date of Patent: Sep. 13, 2022

(54) VANE MIXER IN ENGINE EXHAUST SYSTEM

(71) Applicant: Caterpillar Inc., Peoria, IL (US)

(72) Inventors: Khaja Mohiuddin, Peoria, IL (US); Yong Yi, Dunlap, IL (US); Tejashree Nanasaheb Shirke, Peoria, IL (US); Vikas Bhupendra Sheth, Edwards, IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 17/080,076

(22) Filed: Oct. 26, 2020

(65) Prior Publication Data

US 2022/0127984 A1 Apr. 28, 2022

(51) Int. Cl.

| | |
|---|---|
| ***F01N 3/035*** | (2006.01) |
| ***F01N 13/18*** | (2010.01) |
| ***F01N 3/10*** | (2006.01) |

(52) U.S. Cl.

CPC ..... *F01N 3/035* (2013.01); *F01N 3/106* (2013.01); *F01N 13/1816* (2013.01); *F01N 2250/02* (2013.01); *F01N 2330/38* (2013.01)

(58) Field of Classification Search

CPC ..... F01N 3/035; F01N 3/106; F01N 13/1816; F01N 2250/02; F01N 2330/38

USPC ..... 422/176, 177

See application file for complete search history.

(56) References Cited

U.S. PATENT DOCUMENTS

| | | | | |
|---|---|---|---|---|
| 8,683,790 | B2 | 4/2014 | Ranganathan et al. | |
| 9,010,094 | B2 | 4/2015 | O'Neil et al. | |
| 10,167,761 | B2 | 1/2019 | Kobe et al. | |
| 10,371,032 | B2 | 8/2019 | Kasai et al. | |
| 2010/0077742 | A1 | 4/2010 | Ehlen et al. | |
| 2011/0047974 | A1* | 3/2011 | Henry | F01N 3/2066 60/274 |
| 2014/0286832 | A1 | 9/2014 | Yi | |
| 2015/0290585 | A1 | 10/2015 | Nagata et al. | |
| 2015/0345356 | A1* | 12/2015 | Yi | B01F 5/0473 366/173.2 |
| 2016/0288639 | A1* | 10/2016 | Kikuchi | F01N 13/1855 |

(Continued)

FOREIGN PATENT DOCUMENTS

| | | | |
|---|---|---|---|
| DE | 102013210955 | A1 | 12/2014 |
| FR | 2952311 | A1 | 5/2011 |
| WO | 2015053683 | W | 4/2015 |

OTHER PUBLICATIONS

UK Search Report for Patent Appln. No. GB2114935.6, dated Apr. 4, 2022 (4 pgs).

*Primary Examiner* — Tom P Duong

(74) *Attorney, Agent, or Firm* — Brannon Sowers & Cracraft PC

(57) ABSTRACT

An exhaust system for an internal combustion engine includes an exhaust pipe, and a vane mixer attached to an upstream pipe end of the exhaust pipe and including a fluid injector mount, and a fluid injection side port in the injector mount and fluidly connected to an exhaust passage in the vane mixer. The vane mixer further includes a vane extending across the exhaust passage and dividing the exhaust passage into a major flow area and a minor flow area. The minor flow area is in overlapping angular alignment, circumferentially around a longitudinal exhaust passage axis, with the fluid injection side port.

20 Claims, 5 Drawing Sheets

(56) References Cited

U.S. PATENT DOCUMENTS

2018/0135496 A1* 5/2018 Yi ..... F01N 3/2066
2021/0047957 A1 2/2021 Norris

* cited by examiner

VANE MIXER IN ENGINE EXHAUST SYSTEM

TECHNICAL FIELD

The present disclosure relates generally to an exhaust system for an internal combustion engine, and more particularly to a vane mixer in an exhaust system having a vane positioned for impingement by merging flows of exhaust and injected fluid.

BACKGROUND

Most modern internal combustion engines include some type of equipment for mitigating the emission of certain compounds to ambient. In recent years, and notably with regard to compression-ignition diesel engines, jurisdictional requirements have become increasingly stringent as to allowable limits on emissions of particulate matter and oxides of nitrogen or "NOx". It is common for internal combustion engines to have exhaust systems equipped with various catalysts, traps, and other equipment for filtering such compounds or converting them to less undesired materials.

In a conventional strategy a diesel particulate filter or DPF is used to trap particulate matter, including soot and ash. A selective catalytic reduction module or SCR is often coupled downstream of the DPF to convert NOx to molecular nitrogen and water, for example. Over the course of time catalysts can degrade in performance and filters or traps can accumulate trapped particulates. It is thus desirable to periodically service such equipment, or more preferably regenerate the equipment on-board. In the case of a DPF, various engine operating strategies can be implemented to increase a temperature of the exhaust to a temperature sufficient to combust trapped particulates. Strategies relying upon manipulation of the combustion process itself can have undesired impacts on performance and/or create an unacceptable fuel penalty. Other strategies employ electric heaters in the DPF, expensive precious metal catalysts to enable more or less continuous passive regeneration, or inject a fuel, such as on-board diesel distillate fuel, directly into the stream of exhaust to initiate combustion of trapped particulates. All of these strategies have various advantages in certain applications but also various drawbacks. In the case of active regeneration, where fuel is directly injected into the exhaust, known systems can have insufficient capacity for mixing the injected fuel with the exhaust, and ultimately resulting in undesired emissions of unburned hydrocarbons or interaction between the hydrocarbons and equipment downstream of intended targets. One known active regeneration strategy is set forth in U.S. Pat. No. 9,010,094 to O'Neil et al.

SUMMARY OF THE INVENTION

In one aspect, an exhaust system for an engine includes an exhaust pipe having an upstream pipe end and a downstream pipe end. The exhaust system further includes a vane mixer defining a longitudinal passage axis and forming an exhaust passage extending between a downstream mixer end attached to the upstream pipe end, and an upstream mixer end. The vane mixer includes an injector mount, and a fluid injection side port formed in the injector mount and fluidly connected to the exhaust passage. The vane mixer further includes a vane extending across the exhaust passage and dividing the exhaust passage into a major flow area and a minor flow area. The minor flow area is in overlapping angular alignment, circumferentially around the longitudinal passage axis, with the fluid injection side port.

In another aspect, a vane mixer for an exhaust system in an internal combustion engine includes a mixer body having an exhaust conduit defining a longitudinal passage axis, and having an outer conduit surface, and an inner conduit surface extending circumferentially around the longitudinal passage axis to form an exhaust passage extending between an upstream mixer end and a downstream mixer end. The mixer body further includes an injector mount, and a fluid injection side port formed in the injector amount and defining a transverse port axis forming an acute angle with the longitudinal passage axis. The vane mixer further includes a vane extending across the exhaust passage and having a trailing vane edge positioned downstream of the fluid injection side port, and a leading vane edge positioned for impingement by merging flows of exhaust through the exhaust passage and injected fluid through the fluid injection side port. The vane divides the exhaust passage into a major flow area and a minor flow area, and the minor flow area is in overlapping angular alignment, circumferentially around the longitudinal passage axis, with the fluid injection side port.

In still another aspect, a vane mixer for an exhaust system in an internal combustion includes a mixer body having an exhaust conduit defining a longitudinal passage axis, and having an outer conduit surface, and an inner conduit surface extending circumferentially around the longitudinal axis to form an exhaust passage extending between an upstream mixer end and a downstream mixer end. The mixer body further includes a fluid injection side port fluidly connected to the exhaust passage at a location longitudinally between the upstream mixer end and the downstream mixer end, and defining a transverse port axis intersecting the longitudinal passage axis and forming an acute angle with the longitudinal axis. The vane mixer further includes a vane extending across the exhaust passage and having a trailing vane edge positioned downstream of the fluid injection side port, and a leading vane edge, and a clearance extending, in a longitudinal direction, between the transverse port axis and the leading vane edge.

DETAILED DESCRIPTION

Figure 1:
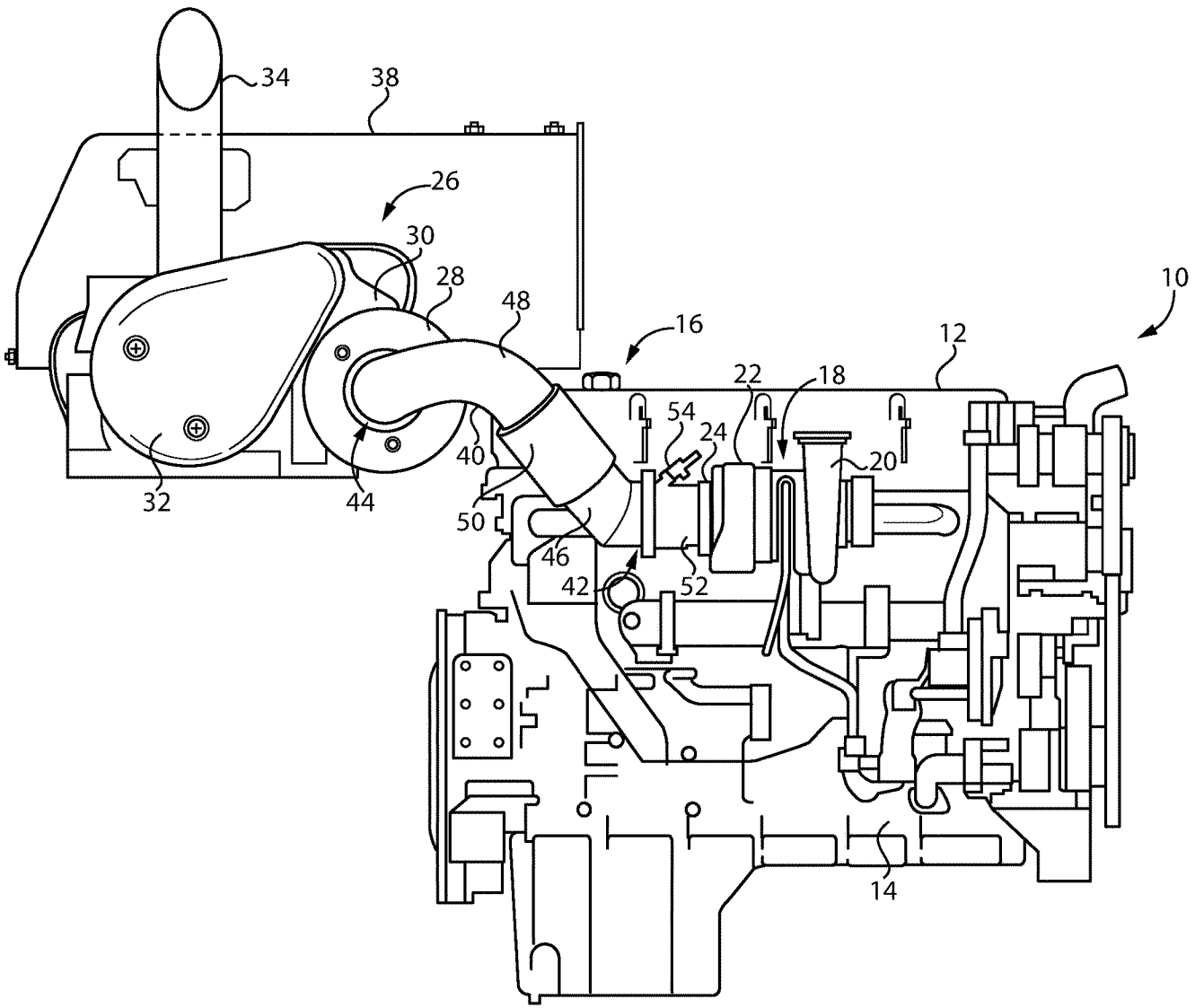
FIG. 1 is a diagrammatic view of an internal combustion engine system, according to one embodiment.
Figure 2:
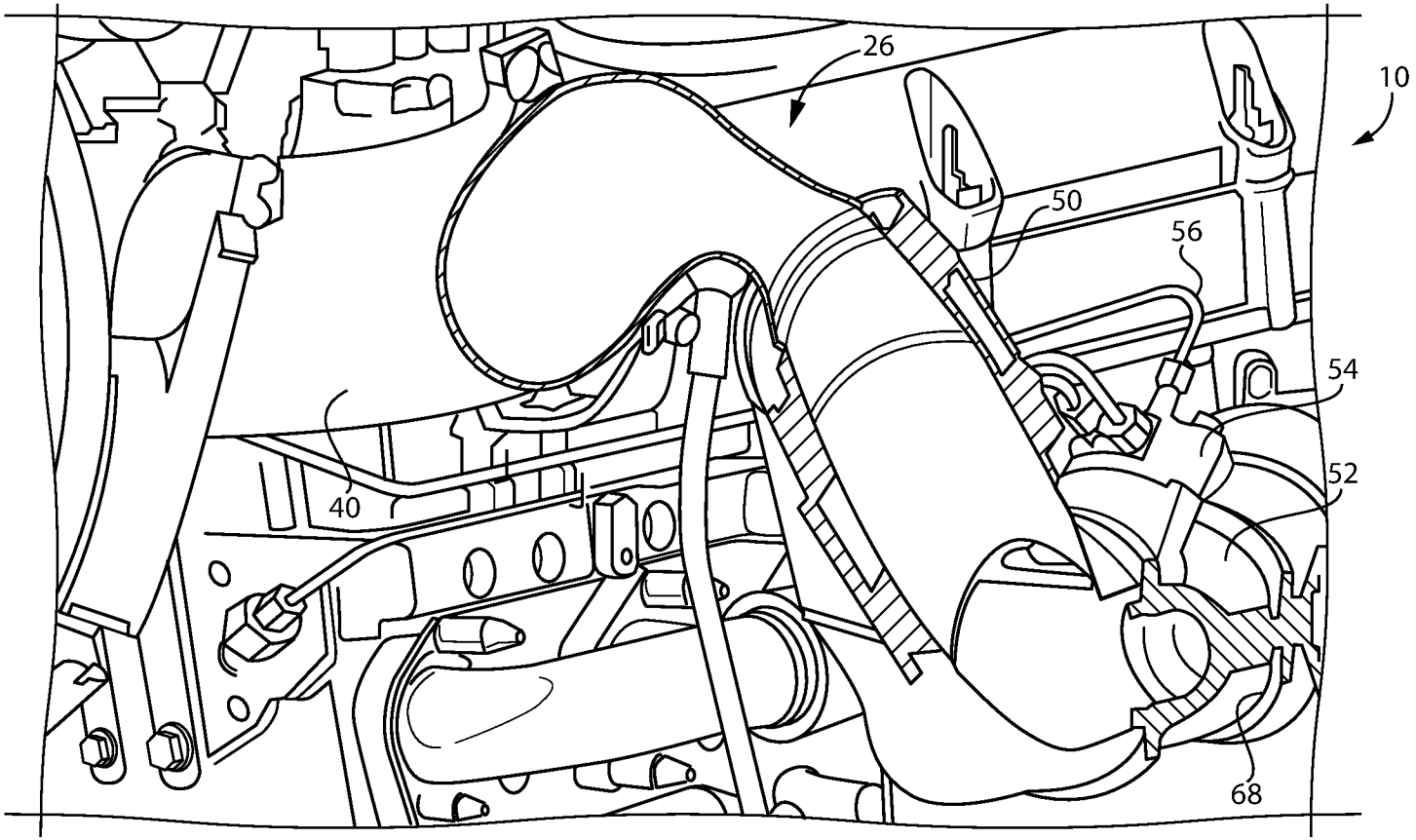
FIG. 2 is a partially sectioned diagrammatic view of portions of the internal combustion engine of FIG. 1.

Referring to FIGS. 1 and 2, there is shown an internal combustion engine system 10 according to one embodiment. Internal combustion engine system 10 (hereinafter "engine system 10") includes an engine 12 having a cylinder block 14. Cylinder block 14 may include therein any number of cylinders in any suitable arrangement. Engine 12 may be a compression-ignition engine including pistons within cylinder block 14 structured to compress a mixture of a fuel, such as a liquid diesel distillate fuel, and air to an autoignition threshold within the cylinders. The present disclosure is not thereby limited, however, and engine 12 could be spark-ignited, a dual fuel engine that is liquid pilot-ignited operating on both a liquid fuel and a gaseous fuel, or still another type. Engine system 10 further includes an exhaust system 16 including a turbocharger 18 having a compressor 20 and a turbine 22 coupled with compressor 20 and including a turbine outlet 24, in a generally conventional manner.

Exhaust system 16 also includes aftertreatment equipment 26 including, for example, a diesel oxidation catalyst 28 or "DOC", a particulate filter 30 or "DPF", and a selective catalytic reduction module 32 or "SCR". Exhaust system 16 also includes an exhaust stack or tail pipe 34 structured to discharge exhaust treated in aftertreatment equipment 26. Some or all of aftertreatment equipment 26 may be positioned inside a hood 38. Engine system 10 can be used in an off-highway machine such as a tractor, a truck, an excavator, or still another. Engine system 10 could also be implemented in a stationary engine-generator set, a pump, a compressor, or still other machine. Exhaust system 16 also includes an exhaust pipe 40 having an upstream pipe end 42 and a downstream pipe end 44. Exhaust pipe 40 forms a first turn 46 and a second turn 48 between upstream pipe end 42 and downstream pipe end 44, and includes a bellows 50 between first turn 46 and second turn 48. Bellows 50 enables some flexing and movement between and among various components of engine system 10 as might be experienced in a mobile machine application, particularly an off-highway machine application. As will be further apparent from the following description, exhaust system 16 is structured for improved performance with respect to fluid injection of a fluid, for example, a liquid fuel, into a stream of exhaust from engine 12, and mixing of the injected fluid with exhaust, as well as improved packaging of exhaust system components.

Referring also now to FIGS. 3-6, exhaust system 16 further includes a vane mixer 52 defining a longitudinal passage axis 62 and forming an exhaust passage 68 extending between a downstream mixer end 72 and an upstream mixer end 70. Downstream mixer end 72 is attached to upstream pipe end 42, and upstream mixer end 70 may be attached to turbine 22 to receive a feed of exhaust from turbine outlet 24. Vane mixer 52 also includes a mixer body 58 having an exhaust conduit 60, defining longitudinal passage axis 62, and having an outer conduit surface 64, and an inner conduit surface 66 extending circumferentially around longitudinal passage axis 62 to form exhaust passage 68. Exhaust passage 68 extends between upstream mixer end 70 and downstream mixer end 72. As used herein the term "upstream" means in a direction of engine 12, or a direction of upstream mixer end 70, and "downstream" means in a direction of tail pipe 34 or downstream mixer end 72.

Mixer body 58 further includes an injector mount 74, and a fluid injection side port 76 formed in injector mount 74 and defining a transverse port axis 78 forming an acute angle 84 with longitudinal axis 62. Acute angle 84 opens in an upstream direction, and may be between 45° and 60°, for example approximately 50°, in some embodiments. Exhaust system 16 further includes a liquid injector 54, for example a fuel injector, mounted to injector mount 74, and structured to inject a liquid fuel into vane mixer 52. A fuel line 56 extends to fuel injector 54 and may provide a supply of liquid fuel, such as diesel distillate fuel from an on-board fuel tank, to fuel injector 54 for injection. Injection of liquid fuel with fuel injector 54 can be used to regenerate aftertreatment equipment 26, in particular DPF 30. Fuel injection can be periodic, continuous, or triggered in response to detection of suitable DPF regeneration conditions. As alluded to above, vane mixer 52 may be structured for improved mixing of injected fuel with exhaust. Improved mixing can in turn enable the use of a relatively shorter length of exhaust pipe 40, a relatively more tortuous path of exhaust pipe 40, or provide other benefits related to efficient and compact packaging and performance of exhaust system 16. In a practical implementation strategy, fuel injector 54 defines an injector axis 57 oriented parallel to transverse port axis 78, and typically colinear with transverse port axis 78. A spray plume of injected fuel from fuel injector 54 may have a spray plume path that is generally parallel to and circumferential of injector axis 57.

Figure 6:
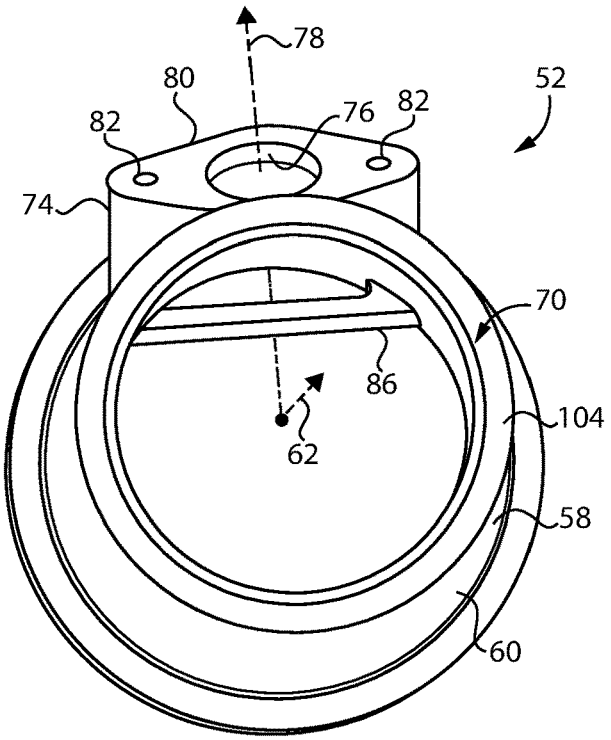
FIG. 6 is another diagrammatic view of the vane mixer of FIG. 3.

As noted above, mixer body 58 may include an injector mount 74. As can be seen in FIG. 6, for example, injector mount 74 may stand proud of outer conduit surface 64 and includes a mounting face 80 having fluid injection side port 76 and a plurality of fastener holes 82 formed therein. Vane mixer 52 further includes a vane 86 extending across exhaust passage 68 that assists in mixing of injected fuel with exhaust, and having a trailing vane edge 88 positioned downstream of fluid injection side port 76, and a leading vane edge 90 positioned for impingement by merging flows of exhaust through exhaust passage 68 and injected fluid, namely, fuel, through fluid injection side port 76. Vane 86 may further divide exhaust passage 68 into a major flow area 92 and a minor flow area 94. A major flow area herein means a flow area having a relatively larger cross-sectional area, and a minor flow area means a flow area having a relatively smaller cross-sectional area. Minor flow area 94 is in overlapping angular alignment, circumferentially around longitudinal passage axis 62, with fluid injection side port 76. In an axial projection plane, such as might be envisioned from FIG. 5, exhaust conduit 60 defines a circle 96 centered on longitudinal passage axis 62. Vane 86 defines a chord 98 of circle 96. Transverse port axis 78 can be understood to bisect minor flow area 94 and to bisect chord 98, in an axial projection plane. Vane 86 may be further understood to include an inside vane surface 87 forming, together with inner conduit surface 60, minor flow area 94 of exhaust passage 68. Vane 86 may also be understood to include an outside vane surface 89 forming, together with inner conduit surface 60, major flow area 92 of exhaust passage 68.

Figure 3:
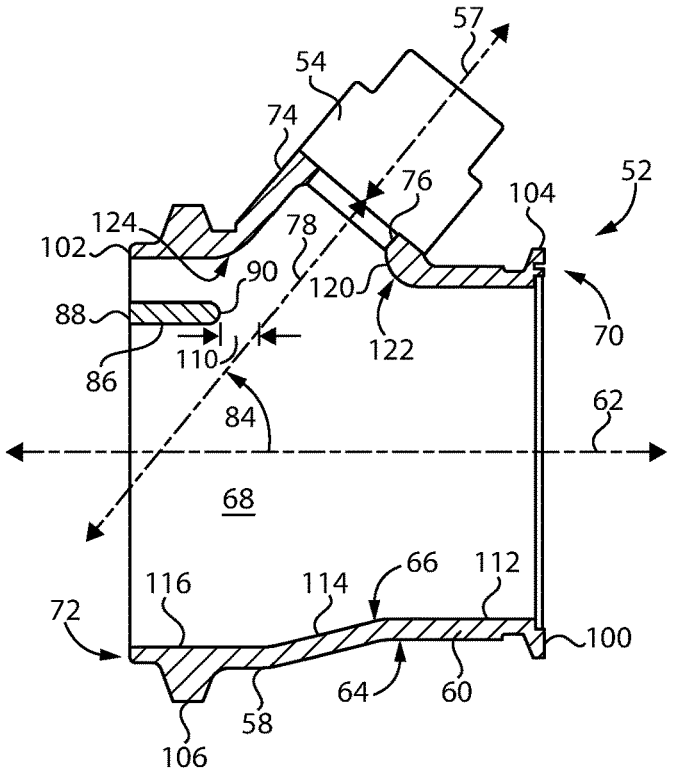
FIG. 3 is a sectioned side diagrammatic view of a vane mixer according to one embodiment.
Figure 4:
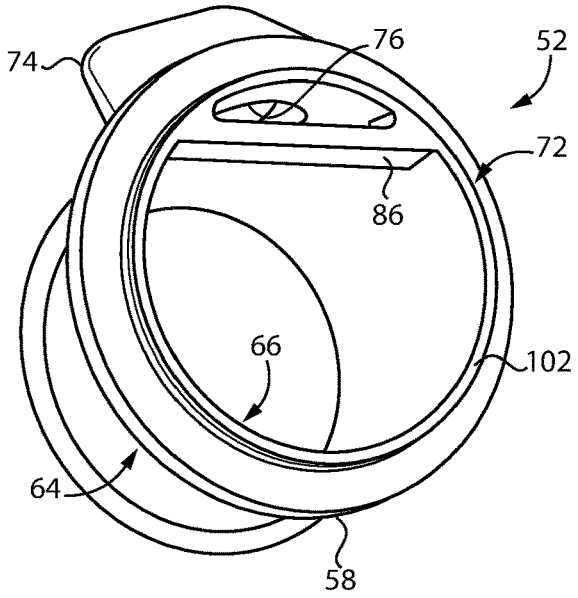
FIG. 4 is another diagrammatic view of the vane mixer of FIG. 3.
Figure 5:
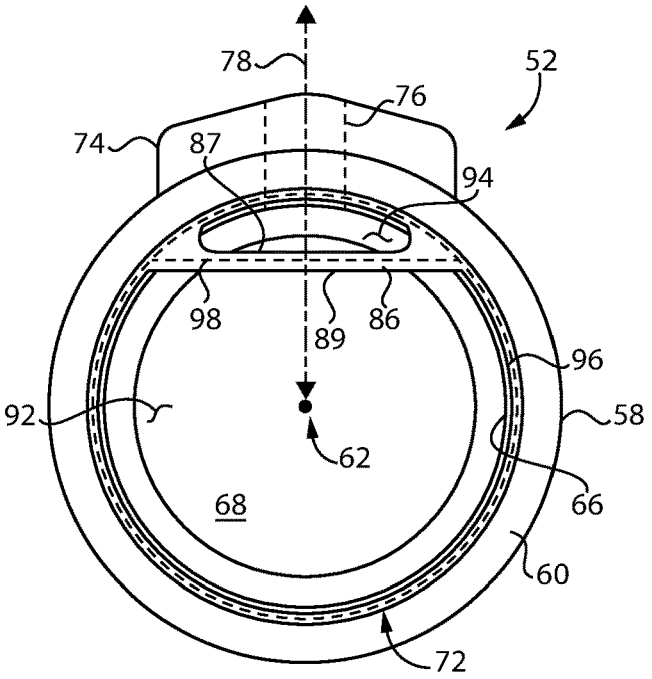
FIG. 5 is an end view of the vane mixer of FIG. 3.

As also shown in FIG. 3, it can be seen that a clearance 110 extends, in a longitudinal direction, between transverse port axis 78 and leading edge 90 of vane 86. Transverse port axis 78 intersects longitudinal passage axis 62 at a location that is downstream of leading vane edge 90 in at least some embodiments. Vane 86 may be oriented generally horizontally to an incoming flow of exhaust, such that inside vane surface 87 and outside vane surface 89 extend generally parallel to longitudinal passage axis 62. It will also be understood in view of further description herein that the location, positioning, orientation, and construction of vane 86 assists in mixing merging flows of injected fuel and exhaust. At lower load operation, where exhaust mass flow and velocity may be relatively less, an injected spray plume of fuel may not directly impinge upon leading edge 90 of vane 86 based upon clearance 110. In other words, a center axis of the fuel spray plume will not impinge upon leading edge 90. At higher loads, with greater exhaust mass flow and greater exhaust velocity, the flow of exhaust in an upstream to downstream direction may be sufficient to deflect the incoming fuel spray plume to directly impinge upon leading edge 90. As a result some of the injected fuel, at least in the higher load case, will flow through minor flow area 94 and some of the injected fuel will flow through major flow area 92, with the separation of flows in this general manner assisting in mixing with the stream of exhaust.

Fluid injection side port 76 may transition with exhaust passage 68 through an opening in conduit 60 formed by a transition surface 120. Transition surface 120 may have a size and a curvature, in a longitudinal section plane as shown in FIG. 3, that is non-uniform. A first radius 122 formed by transition surface 120 on an upstream side of fluid injection side port 76 may be relatively smaller, and a second radius 124 formed by transition surface 120 at a downstream side of fluid injection side port 76 may be relatively larger. In a practical implementation sizes of radiuses 122 and 124 may be between 10 millimeters and 20 millimeters. The larger size of radius 124 can assist in profiling the downstream side of the fluid injection side port 76 so as to limit or avoid impingement of injected fuel spray upon inner conduit surface 66 and/or inside surfaces of fluid injection side port 76.

It can also be noted from FIG. 3, and the other Figures, that inner conduit surface 66 may be understood to form an incoming exhaust passage segment 112, an outgoing exhaust passage segment 116, and a middle exhaust passage segment 114. Outgoing exhaust passage segment 116 may be larger in diameter than incoming exhaust passage segment 112. Middle exhaust passage segment 114 may have a diameter that is increased, in a longitudinal direction, from incoming exhaust passage segment 112 to outgoing exhaust passage segment 116. Fluid injection side port 76 may open to middle exhaust passage segment 114 such that the enlarging diameter of middle exhaust passage segment 114 and the larger diameter of outgoing exhaust passage segment 116, assist in providing additional volume for mixing of injected fuel with exhaust. It can also be seen from the Figures that upstream mixer end 70 includes a first axial end surface 100. First axial end surface 100 may be formed on a connecting flange 104 of upstream mixer end 70. Downstream mixer end 72 includes a second axial end surface 102, and a second flange 106 adjacent to second axial end surface 102 and spaced upstream of second axial end surface 102. Trailing vane edge 88 may be coplanar with second axial end surface 102.

INDUSTRIAL APPLICABILITY

Figure 7:
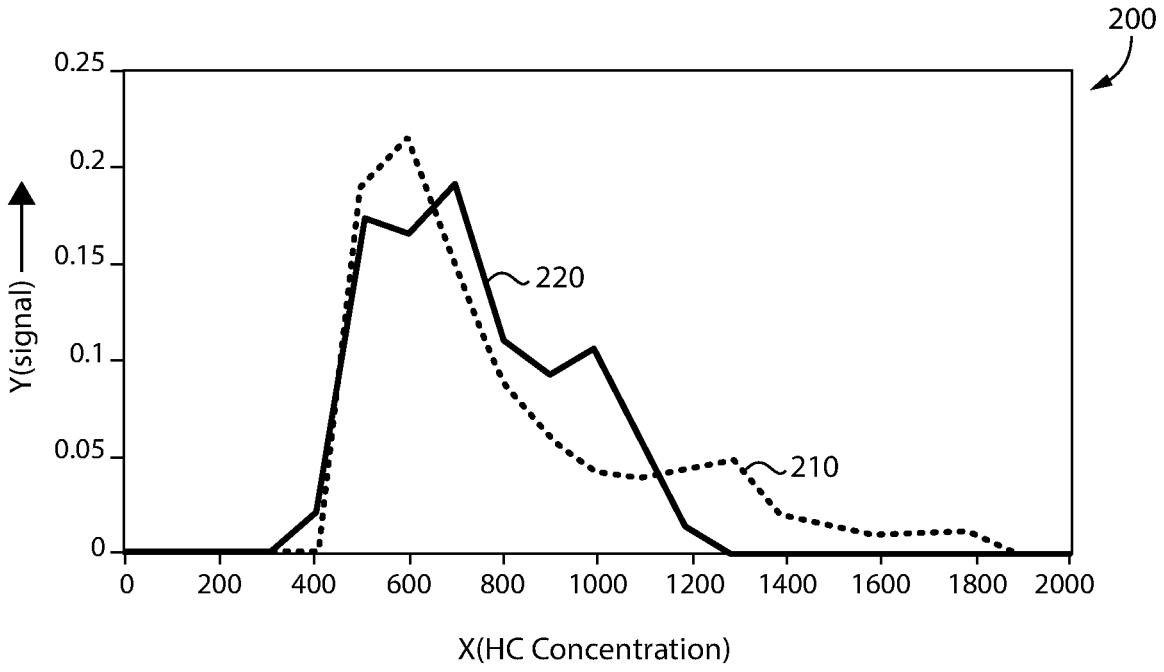
FIG. 7 is a graph illustrating unburned hydrocarbon concentrations in an exhaust system according to the present disclosure in comparison with another exhaust system.

Referring to the drawings generally, but also now to FIG. 7, illustrating a graph 200 of unburned hydrocarbon concentrations for an exhaust system according to the present disclosure at line 220, in comparison with unburned hydrocarbon concentrations for an exhaust system not employing a vane mixer. In graph 200, the X-axis illustrates hydrocarbon concentrations in parts per million, and the Y-axis illustrates a percentage of flow channels in an exhaust system component, such as a DOC, where the respective unburned hydrocarbon concentrations are detected. It can be seen that in the case of the exhaust system operated with a vane mixer according to the present disclosure, unburned hydrocarbons are significantly lower than in the system without a vane mixer, particularly at concentrations from about 400 parts per million to about 650 parts per million.

It has been observed in certain earlier exhaust systems that injected liquid fuel can fail to optimally vaporize and mix where a relatively shorter exhaust pipe or "flex pipe" is used, leading to relatively poor quality of fuel mixing, particularly at higher flow rates given a reduced residence time available for such mixing and higher temperatures in channels in a DOC. It may also be challenging with a relatively shorter length exhaust pipe to maintain the pipe leak free. Relatively longer exhaust pipe, however, requires an extension of packaging width which may be unacceptable for various reasons including cost. Traditional mixers, obstructing much of an exhaust pipe, can address such challenges, but tend to produce a pressure drop penalty that may be undesired. Conventional mixing strategies and mixing hardware may also be less reliable over the course of a performance life or service interval. The present disclosure provides for improved mixing without such drawbacks, enabling dispersion of a fuel spray from a fuel injector that supports the use of a shorter exhaust pipe, better vaporization to limit leakage, and potentially other advantages, especially with regard to compact packaging.

The present description is for illustrative purposes only, and should not be construed to narrow the breadth of the present disclosure in any way. Thus, those skilled in the art will appreciate that various modifications might be made to the presently disclosed embodiments without departing from the full and fair scope and spirit of the present disclosure. Other aspects, features and advantages will be apparent upon an examination of the attached drawings and appended claims. As used herein, the articles "a" and "an" are intended to include one or more items, and may be used interchangeably with "one or more." Where only one item is intended, the term "one" or similar language is used. Also, as used herein, the terms "has," "have," "having," or the like are intended to be open-ended terms. Further, the phrase "based on" is intended to mean "based, at least in part, on" unless explicitly stated otherwise.

What is claimed is:

1. An exhaust system for an engine comprising:

an exhaust pipe including an upstream pipe end and a downstream pipe end;

a vane mixer defining a longitudinal passage axis and forming an exhaust passage extending between a downstream mixer end attached to the upstream pipe end, and an upstream mixer end, and including an injector mount, and a fluid injection side port formed in the injector mount and fluidly connected to the exhaust passage; and the vane mixer further including a vane extending across the exhaust passage and dividing the exhaust passage into a major flow area and a minor flow area, and the minor flow area is in overlapping angular alignment, circumferentially around the longitudinal passage axis, with the fluid injection side port, and extends from an originating location to a terminating location each downstream of the fluid injection side port.

2. The exhaust system of claim 1 wherein the exhaust pipe forms a first turn and a second turn between the upstream pipe end and the downstream pipe end, and includes a bellows between the first turn and the second turn.

3. The exhaust system of claim 2 further comprising an exhaust turbine fluidly connected to the upstream pipe end, a diesel oxidation catalyst (DOC) fluidly connected to the downstream pipe end, and a particulate filter (DPF) fluidly connected to the DOC.

4. The exhaust system of claim 1 wherein the fluid injection side port defines a transverse port axis intersecting the longitudinal passage axis and forming an acute angle with the longitudinal passage axis opening in an upstream direction.

5. The exhaust system of claim 4 further comprising a fuel injector mounted to the injector mount and structured to inject a liquid fuel into the vane mixer, and wherein the fuel injector defines an injector axis parallel to the transverse port axis, and the acute angle is between 45° and 60°.

6. The exhaust system of claim 4 wherein the vane includes a trailing edge positioned downstream of the fluid injection side port, and a leading edge, and a clearance extends, in a longitudinal direction, between the transverse port axis and the leading edge of the vane.

7. The exhaust system of claim 4 wherein the minor flow area is bisected by the transverse port axis, in an axial projection plane.

8. A vane mixer for an exhaust system in an internal combustion engine comprising:

a mixer body including an exhaust conduit defining a longitudinal passage axis, and having an outer conduit surface, and an inner conduit surface extending circumferentially around the longitudinal axis to form an exhaust passage extending between an upstream mixer end and a downstream mixer end;

the mixer body further including an injector mount, and a fluid injection side port formed in the injector mount and defining a transverse port axis forming an acute angle with the longitudinal passage axis; and a vane extending across the exhaust passage and including a trailing vane edge positioned downstream of the fluid injection side port, and a leading vane edge positioned for impingement by merging flows of exhaust through the exhaust passage and injected fluid through the fluid injection side port in a spray plume path parallel to the transverse port axis;

the vane dividing the exhaust passage into a major flow area and a minor flow area, and the minor flow area is in overlapping angular alignment, circumferentially around the longitudinal passage axis, with the fluid injection side port.

9. The vane mixer of claim 8 wherein the exhaust conduit defines a circle centered on the longitudinal axis, and the vane defines a chord of the circle, and the transverse port axis bisects the minor flow area and the chord of the circle, in an axial projection plane.

10. The vane mixer of claim 9 wherein the vane and the mixer body are formed integrally in a single piece.

11. The exhaust system of claim 8 wherein the upstream mixer end includes a first axial end surface, and the downstream mixer end includes a second axial end surface, and the trailing vane edge is coplanar with the second axial end surface.

12. The vane mixer of claim 8 wherein a clearance extends, in a longitudinal direction, between the transverse port axis and the leading vane edge.

13. The vane mixer of claim 8 wherein the injector mount stands proud of the outer conduit surface and includes a mounting face having the fluid injection side port and a plurality of fastener holes formed therein.

14. The vane mixer of claim 8 wherein the inner conduit surface forms an incoming exhaust passage segment, an outgoing exhaust passage segment, and a middle exhaust passage segment, and the outgoing exhaust passage segment is larger in diameter than the incoming exhaust passage segment.

15. The vane mixer of claim 14 wherein the middle exhaust passage segment has a diameter that is increased, in a longitudinal direction, from the incoming exhaust passage segment to the outgoing exhaust passage segment, and the fluid injection side port opens to the middle exhaust passage segment.

16. The vane mixer of claim 8 wherein the minor flow area is less than the major flow area by a factor greater than 10.

17. The vane mixer of claim 8 wherein the upstream mixer end includes a connecting flange forming a first axial end surface of the mixer body, and the downstream mixer end includes a second axial end surface of the mixer body, and a second connecting flange is formed adjacent to the second axial end surface.

18. A vane mixer for an exhaust system in an internal combustion engine comprising:

a mixer body including an exhaust conduit defining a longitudinal passage axis, and having an outer conduit surface, and an inner conduit surface extending circumferentially around the longitudinal axis to form an exhaust passage extending between an upstream mixer end and a downstream mixer end;

the mixer body further including a fluid injection side port fluidly connected to the exhaust passage at a location longitudinally between the upstream mixer end and the downstream mixer end, and defining a transverse port axis intersecting the longitudinal passage axis and forming an acute angle with the longitudinal passage axis; and a vane extending across the exhaust passage and including a trailing vane edge positioned downstream of the fluid injection side port, and a leading vane edge, and a clearance extends, in a longitudinal direction parallel to the longitudinal passage axis, between the transverse port axis and the leading vane edge.

19. The vane mixer of claim 18 wherein:

the vane includes an inside vane surface forming, together with the inner conduit surface, a minor flow area of the exhaust passage, and an outside vane surface forming, together with the inner conduit surface, a major flow area of the exhaust passage; and the minor flow area is in overlapping angular alignment, circumferentially around the longitudinal passage axis, with the fluid injection side port;

the inner conduit surface forms an incoming exhaust passage segment, an outgoing exhaust passage segment, and a middle exhaust passage segment; and the middle exhaust passage segment has a diameter that is increased, in a longitudinal direction, from the incoming exhaust passage segment to the outgoing exhaust passage segment, and the fluid injection side port opens to the middle exhaust passage segment.

20. The vane mixer of claim 19 wherein the transverse bore axis intersects the longitudinal passage axis at a location that is downstream of the leading vane edge.

* * * * *